US007175384B2

(12) United States Patent
Algers

(10) Patent No.: US 7,175,384 B2
(45) Date of Patent: Feb. 13, 2007

(54) CENTRIFUGAL PUMP

(75) Inventor: Bengt Algers, Kvarndalen (SE)

(73) Assignee: ABS Pump Production AB, Molndal (SE)

( * ) Notice: Subject to any disclaimer, the term of this patent is extended or adjusted under 35 U.S.C. 154(b) by 0 days.

(21) Appl. No.: 10/194,541

(22) Filed: Jul. 11, 2002

(65) Prior Publication Data

US 2003/0021690 A1 Jan. 30, 2003

(30) Foreign Application Priority Data

Jul. 13, 2001 (SE) ..... 0102552

(51) Int. Cl.
*F04D 29/22* (2006.01)
*F04D 29/10* (2006.01)

(52) U.S. Cl. ..... 415/58.2; 415/106; 415/171.1; 416/181

(58) Field of Classification Search ..... 415/106, 415/171.1, 169.1, 58.2, 58.3; 416/181, 231 R, 416/185, 186 R
See application file for complete search history.

(56) References Cited

U.S. PATENT DOCUMENTS

| | | | | | |
|---|---|---|---|---|---|
| 772,532 | A | * | 10/1904 | Ray | 415/106 |
| 948,228 | A | * | 2/1910 | Krough | 415/106 |
| 1,871,747 | A | | 8/1932 | Schlachter | |
| 1,967,316 | A | * | 7/1934 | Meeker | 415/106 |
| 3,230,890 | A | * | 1/1966 | Hidekuni et al. | 415/169.1 |
| 3,316,848 | A | | 5/1967 | Egger | |
| 3,663,117 | A | * | 5/1972 | Warren | 415/106 |
| 4,190,396 | A | | 2/1980 | Tomioka et al. | |
| 4,884,945 | A | * | 12/1989 | Boutin et al. | 415/171.1 |
| 4,936,744 | A | | 6/1990 | Dosch et al. | |
| 5,156,522 | A | | 10/1992 | Tessier | |
| 5,570,998 | A | | 11/1996 | Nomoto | |
| 5,609,468 | A | * | 3/1997 | Burgess | 415/171.1 |
| 5,628,616 | A | | 5/1997 | Lee | |
| 5,816,784 | A | * | 10/1998 | Postuchow et al. | 415/171.1 |
| 5,921,748 | A | * | 7/1999 | Frater | 415/171.1 |
| 6,224,322 | B1 | * | 5/2001 | Calboreanu | 415/34 |

FOREIGN PATENT DOCUMENTS

| | | |
|---|---|---|
| DE | 196 06 856 | 8/1996 |

* cited by examiner

*Primary Examiner*—Christopher Verdier
(74) *Attorney, Agent, or Firm*—Merchant & Gould P.C.

(57) ABSTRACT

A centrifugal pump, the impeller (2) of the pump having one or more holes through the impeller adjacent to its hub. The hole or holes (7) are positioned between the vanes (3) of the impeller and closer to the hub than the periphery of the impeller. The total area of the holes is more than 0.4% of the area of the impeller, preferably 0.5–0.6% of the area of the impeller or more than 2% of the inlet area of the pump, preferably 2.5–5% of the inlet area. Preferably there is a cavity or a pit (8) at the back of the impeller.

9 Claims, 2 Drawing Sheets

CENTRIFUGAL PUMP

The present invention is for an impeller for centrifugal pumps, primarily those having dynamic sealing. By the invention a simplified design of the sealing and reduced energy losses are achieved which gives an economical advantage.

At centrifugal pumps sealing is by means of mechanical seals or dynamic sealing combined with simpler mechanical sealing. The means for dynamic sealing comprise impellers that are mounted on to the outgoing shaft of the pump impeller and bring about a back pressure at the water that tends to flow out behind the pump impeller so that an equilibrium is achieved. Dynamic sealing is preferably used with pumps having impellers with rear vanes in order to bring about the desired pressure conditions. A centrifugal pump has a circular impeller that rotates inside a spiral housing which causes an uneven pressure distribution if the speed of rotation of the impeller is not exactly that for which the pump has been designed. This also causes cross flow behind the impeller. By the rear vanes there is an equalisation of the pressure at the rear side of the impeller. Air or gases that accumulate behind the pump impeller may cause problems with the proper functioning of the dynamic sealing. In order to evacuate the space behind the impeller, especially at pumps having a rear sealing ring, it is known to make a comparatively small hole through the impeller where the area of the hole is not larger than about 0.5% of the inlet area or about 0.1–0.2% of the area of the impeller.

The cost of energy is the major cost of a pump calculated for its entire life. The rear vanes consume some of the energy that is supplied to the pump by that the work done by the impellers of the dynamic sealing requires energy and are losses that reduce the efficiency of the pump. A reduction of the comparatively high pressure at the outgoing shaft will bring with it both reduced energy losses and a possible reduction of the number of impellers. If the energy supplied is, for example, 100 kW where 4 kW of thereof are consumed by the rear vanes and the dynamic sealing, as the time of operation may be more than 8000 hours per year for 20 years this is a considerable cost. A reduction of the energy needed for these purposes will thus mean a considerable reduction of the costs.

It is an object of the present invention to achieve a design of a centrifugal pump which gives an energy efficient reduction of the pressure at the rear side of the pump impeller so that the losses of efficiency caused by the rear vanes and the sealing are considerably reduced. It is also an object of the invention to achieve a design of a centrifugal pump that brings with it a reduction of the costs of manufacturing.

The invention may be applied both at closed and semi open pump impellers. A pump impeller for a centrifugal pump according to the invention comprises one or more open holes through the pump impeller in the vicinity of its hub. The holes are positioned between the vanes and closer to the hub of the impeller than to its periphery. The shortest suitable distance from the centre of the impeller is determined by the design of the impeller and the thickness of the goods closest to the hub. The total area of the holes is related to other dimensions of the pump and is primarily related to the impeller area and the inlet area of the pump. Further, the impeller has no rear vanes or rear vanes of such sizes than that the pressure behind the impeller at the holes is greater than the inlet pressure over the entire range of operating conditions of the pump. The holes cause a minor backflow of liquid to the inlet side of the pump impeller and the pressure that the dynamic sealing shall counteract is reduced. It has turned out that the losses of energy that are caused by the backflow are considerably smaller than what is gained at the dynamic sealing. It has also turned out that the best results are achieved if there is a cavity or pit at the rear side of the pump impeller at the area where the holes are positioned.

The characterizing features of the pump impeller according to the invention and embodiments thereof are mentioned in the claims.

The invention will below be described more in detail with reference to the example of embodiments thereof that are disclosed in the figures.

Figure 1:
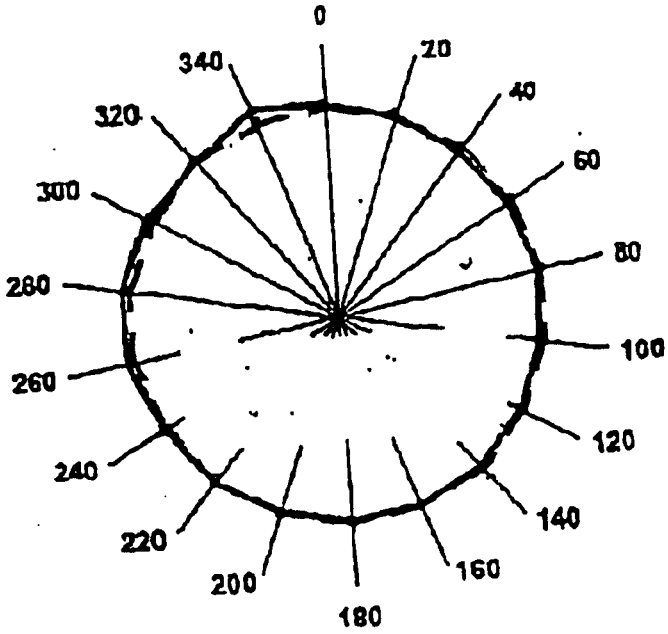
FIG. 1 shows the pressure distribution inside the pump housing at optimal conditions.
Figure 2:
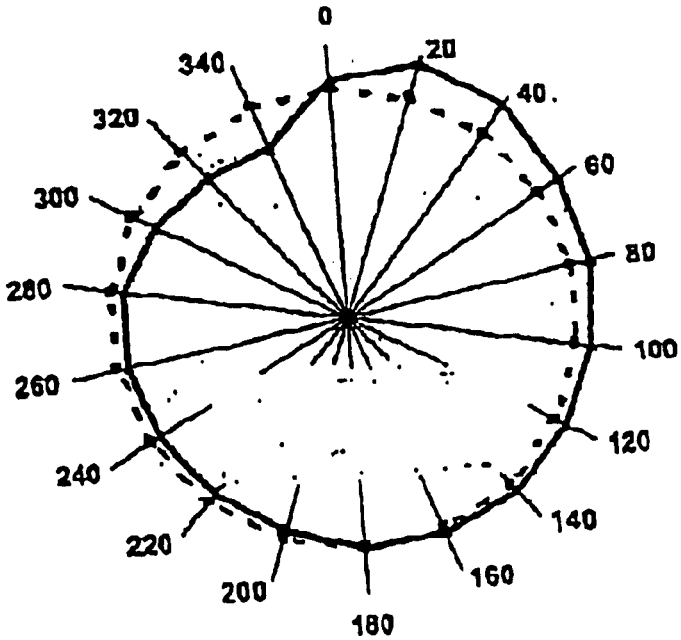
FIG. 2 shows the pressure distribution in the pump housing at a lower than optimal flow.
Figure 3:
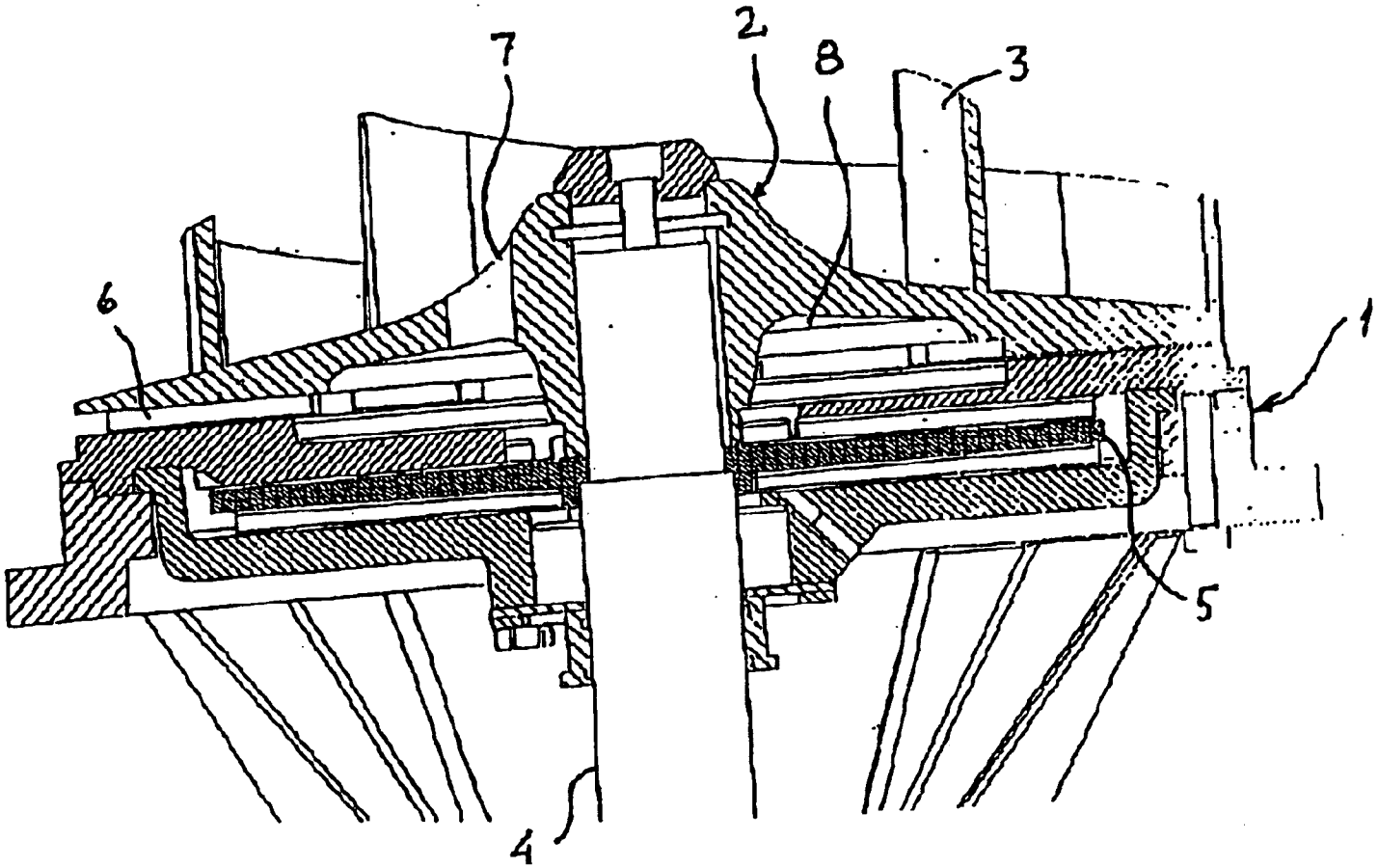
FIG. 3 is a cross section of a pump having a pump impeller according to the invention.

A centrifugal pump comprises a pump housing 1, a pump impeller 2 having two or more vanes 3 and a driving shaft 4 for the pump impeller. The driving shaft starts at an electrical motor of a suitable kind. The housing has an inlet opening having a given inlet area. Opposite to the inlet the shaft 4 passes out through the housing and the pump here has a dynamic sealing. Most often a dynamic sealing has two impellers, however, at pumps according to the invention only one impeller 5 is needed. A the pump shown in the figure there are also rear vanes 6 at the rear side of the pump impeller, however, these vanes are of small dimensions. Adjacent the hub of the pump impeller there is a through hole 7 and preferably one such hole is provided between each pair of adjacent vanes, if for example the pump impeller has five vanes then there are five holes. The total area of the holes is more than 0.4% of the area of the impeller, preferably 0.5–0.6% of the area of the impeller, or more than 2% of the inlet area of the pump, preferably 2.6–6% of the inlet area of the pump, preferably distributed over several holes having the same size and position relative to the centre axle of the pump impeller. The holes, which are shown in a preferred embodiment in the figures parallel to the shaft of the pump may also be made at an angle thereto and having circular or other cross section. Thereby that there is a relationship between the inlet area and the other dimensions of the pump the total area of the holes 7 may also in most cases be said to be 0.5–0.6% of the area of the impeller. The space behind the impeller and the back of the impeller are so designed that the leakage to the front side through the holes 7 is limited by that the decrease of the pressure towards the center will be great enough by the relatively increasing speed of rotation. It has then surprisingly turned out that there will be more favourable conditions if there is a cavity or pit 8 at the back of the impeller. The cavity may have a circular shape and have the same center axis as the impeller.

The table below gives some examples of embodiments according to the invention.

| Ex nr | Inlet area cm2 | Impeller area cm2 | Hole area cm2 | Hole/Inlet % | Hole/Impeller % |
|---|---|---|---|---|---|
| 1 | 314 | 1411 | 7.1 | 2.25 | 0.50 |
| 2 | 419 | 1411 | 7.1 | 1.44 | 0.50 |
| 3 | 314 | 876 | 4.9 | 1.56 | 0.56 |
| 4 | 491 | 876 | 4.9 | 1.00 | 0.56 |
| 5 | 79 | 547 | 3.1 | 4.00 | 0.67 |

What is claimed is:

1. A centrifugal pump comprising:

a pump housing, wherein the housing has an inlet opening having an inlet area, a driving shaft, wherein the shaft passes out through the housing opposite the inlet, wherein the pump is dynamically sealed at the shaft, a pump impeller comprising a hub, a front and a back, two or more front vanes, and one or more holes through the impeller adjacent to the hub, wherein the hole or holes are sized to allow a backflow of liquid to the inlet side of the pump to reduce pressure on the dynamically sealed pump, rear vanes on the back side of the impeller, said rear vanes are sized so that the pressure behind the hole or holes of the impeller is greater than the inlet pressure over the entire operating range of the pump.

2. Centrifugal pump according to claim 1 wherein the hole or holes are positioned between the front vanes of the impeller and closer to the hub than a periphery of the impeller.

3. Centrifugal pump according to claim 1 wherein a total hole area is more than 0.4% of an area of the impeller.

4. Centrifugal pump according to claim 3 wherein the total hole area is between 0.5–0.6% of the area of the impeller.

5. Centrifugal pump according to claim 1 wherein a total area of the hole or holes is more than 2% of the inlet area of the pump.

6. Centrifugal pump according to claim 5 wherein the total area of the hole or holes is between 2.5–5% of the inlet area.

7. Centrifugal pump according to claim 1 wherein a total hole area is distributed over several holes.

8. Centrifugal pump according to claim 7 wherein the several holes are of a same size and have a same position relative to the shaft of the impeller.

9. Centrifugal pump according to claim 1 wherein there is a cavity or pit at the back of the impeller.

* * * * *